US010450744B2

(12) United States Patent
Hall et al.

(10) Patent No.: US 10,450,744 B2
(45) Date of Patent: Oct. 22, 2019

(54) AUTOMATED LIFTING FLOOR FOR UNDERFLOOR STORAGE

(71) Applicants: David R. Hall, Provo, UT (US); Benjamin Jensen, Orem, UT (US); Max Tarver, Provo, UT (US)

(72) Inventors: David R. Hall, Provo, UT (US); Benjamin Jensen, Orem, UT (US); Max Tarver, Provo, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 15/420,578

(22) Filed: Jan. 31, 2017

(65) Prior Publication Data

US 2018/0216345 A1 Aug. 2, 2018

(51) Int. Cl.
*E04B 5/43* (2006.01)

(52) U.S. Cl.
CPC ..... *E04B 5/43* (2013.01)

(58) Field of Classification Search
CPC ..... E04B 5/43; E04B 5/02; A47B 9/20; A47B 81/00; A47B 51/00; A47B 46/005; A47B 47/0091; A47B 2200/0052; A47B 2220/13
See application file for complete search history.

(56) References Cited

U.S. PATENT DOCUMENTS 3,399,887 A * 9/1968 Altier ..... A63J 1/00 187/274
3,812,631 A * 5/1974 Cruse ..... E04H 3/26 52/1
4,633,625 A * 1/1987 Dieban ..... E04H 3/26 108/91
4,638,610 A * 1/1987 Heikkinen ..... B66F 7/0608 108/145
6,338,596 B1 * 1/2002 Galeazzi ..... B65F 1/1457 220/484
9,291,356 B2 * 3/2016 Demster ..... F24F 1/022
9,874,007 B2 * 1/2018 Malitskiy ..... E04H 3/12

* cited by examiner

*Primary Examiner* — Patrick J Maestri

(57) ABSTRACT

The invention is a lifting floor system. An underfloor support structure is divided into a number of partitions, and each partition is equipped with one or more lifting devices. A frame nests removably inside each partition, each frame having a floor piece at the top and a sub-floor piece at the bottom. The one or more lifting devices lift the frames from within the partitions, exposing usable space between each floor piece and sub-floor piece. The space is preferably large enough to store large items such as household appliances and furniture. The underfloor support structure is preferably modular and flat packable. The frames may have organizational features, such as shelves, hanging rods, or slide-out floors.

15 Claims, 12 Drawing Sheets

AUTOMATED LIFTING FLOOR FOR UNDERFLOOR STORAGE

CROSS-REFERENCES

Technical Field

This invention relates generally to the field of building construction, and more specifically to lifting floors and underfloor storage.

Background

The most common current building techniques involve the use of standardized building components that are shipped to a construction site in small pieces and assembled on site. When such methods are used, however, a building or other structure can take months or even years to build. The building project is consequently subjected to unpredictable weather conditions, and great exertions must be made to store and protect tools and resources. Additionally, even though efficient modern assembly techniques have driven down prices for many industrial and consumer products—such as cars, machinery, clothing, and electronics—such techniques are not fully taken advantage of in constructing buildings. Overall, current methods lose the potential benefits of quality, precision, efficiency, and optimal timing that could be possible through the manufacture of modular building segments in a controlled environment.

Furthermore, current building techniques seldom lead to optimally green or sustainable structures. Especially in sprawling urban environments, there is an ever-pressing need for more space. However, most buildings and other structures fail to optimally utilize the space available. For example, few buildings make use of an area of wasted space within the frame of the roof or ceiling.

In view of the foregoing, what is needed is a method of constructing a building infrastructure that utilizes modular building segments, especially where the modular building segments are arranged such that areas within the frame of the roof or ceiling can be accessed and utilized. In particular, what is needed is a system whereby space within the floor can be conveniently made available and utilized for storage.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow for a modular underfloor infrastructure with space for storage in lifting storage units.

Consistent with the foregoing, a lifting floor system is disclosed. The lifting floor system comprises an underfloor support structure, which has a plurality of partitions. Each partition comprises one or more lifting devices. A plurality of frames nest removably inside the plurality of partitions. Each frame has a floor piece mounted atop the frame and a sub-floor piece mounted to a bottom of the frame. The one or more lifting devices lift the plurality of frames from within the plurality of partitions of the underfloor support structure, exposing usable space between each floor piece and sub-floor piece.

In one embodiment, the one or more lifting devices are four lifting columns, though in other embodiments they are telescoping rods, scissor lifts, linear actuators, or other devices. The plurality of partitions and the plurality of frames are preferably rectangular prisms, measuring approximately eight feet long by four feet wide and four feet high. The underfloor support structure preferably comprises modular units that consist of flat packable components and sound-proofing materials. In one embodiment, the one or more lifting devices are attached to and lift the floor pieces, and the plurality of frames hang from the floor pieces such that the frames lift when the floor pieces are lifted. Finally, the frames may comprise shelves, hanging rods, or slide-out floors, and they may be used for storing anything from household appliances to household furniture.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
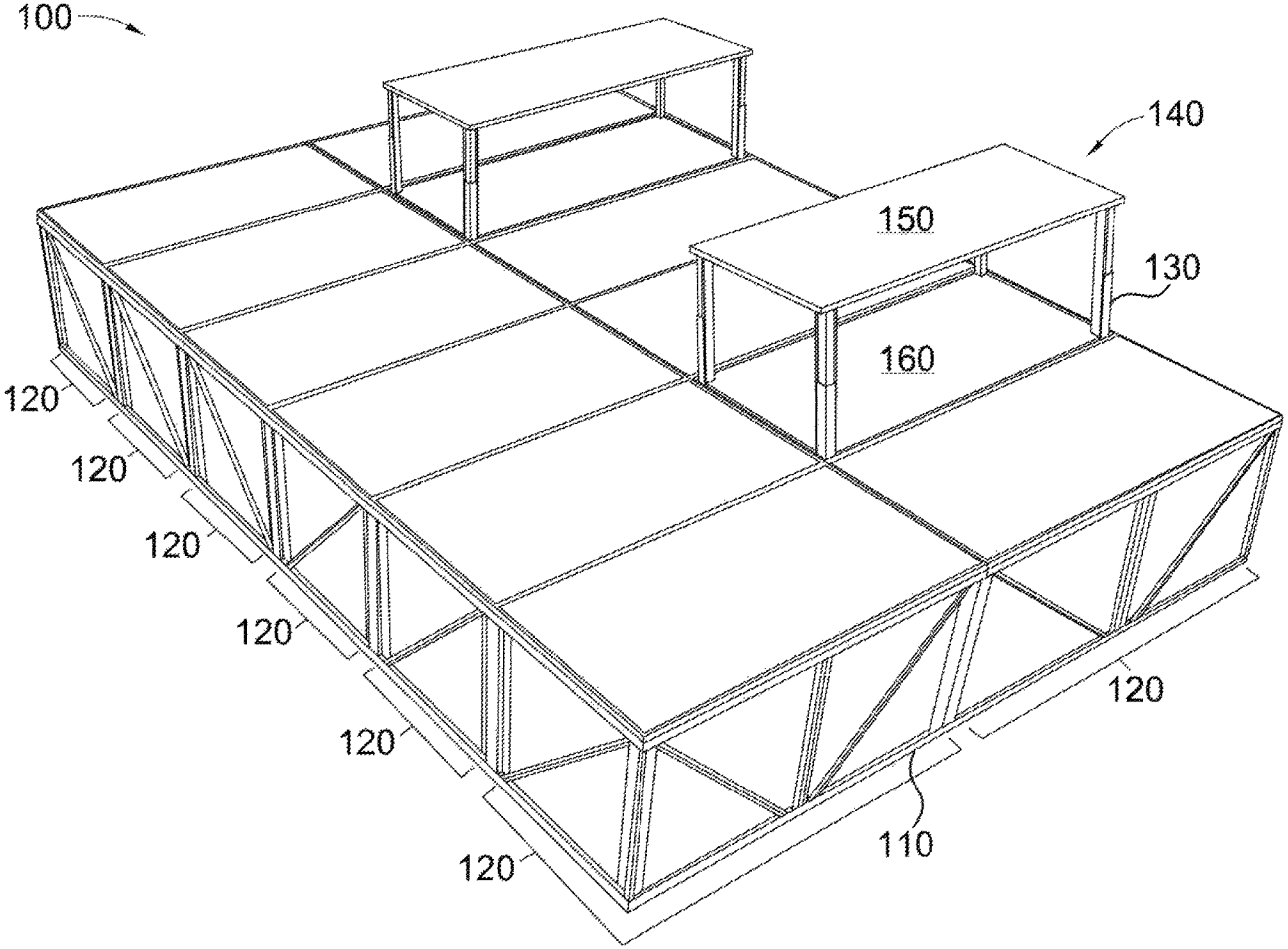
FIG. 1 depicts one embodiment of a lifting floor system.

FIG. 1 depicts one embodiment of a lifting floor system 100. The lifting floor system 100 comprises an underfloor support structure 110. The underfloor support structure 110 comprises a plurality of partitions 120, each partition 120 comprising one or more lifting devices 130. The lifting floor system 100 also comprises a plurality of frames 140 that nest removably inside the plurality of partitions 120. Each frame 140 comprises a floor piece 150 mounted atop the frame 140 and a sub-floor piece 160 mounted to a bottom of the frame 140. The one or more lifting devices 130 lift the plurality of frames 140 from within the plurality of partitions 120 of the underfloor support structure, exposing usable space between each floor piece 150 and sub-floor piece 160.

Figure 2:
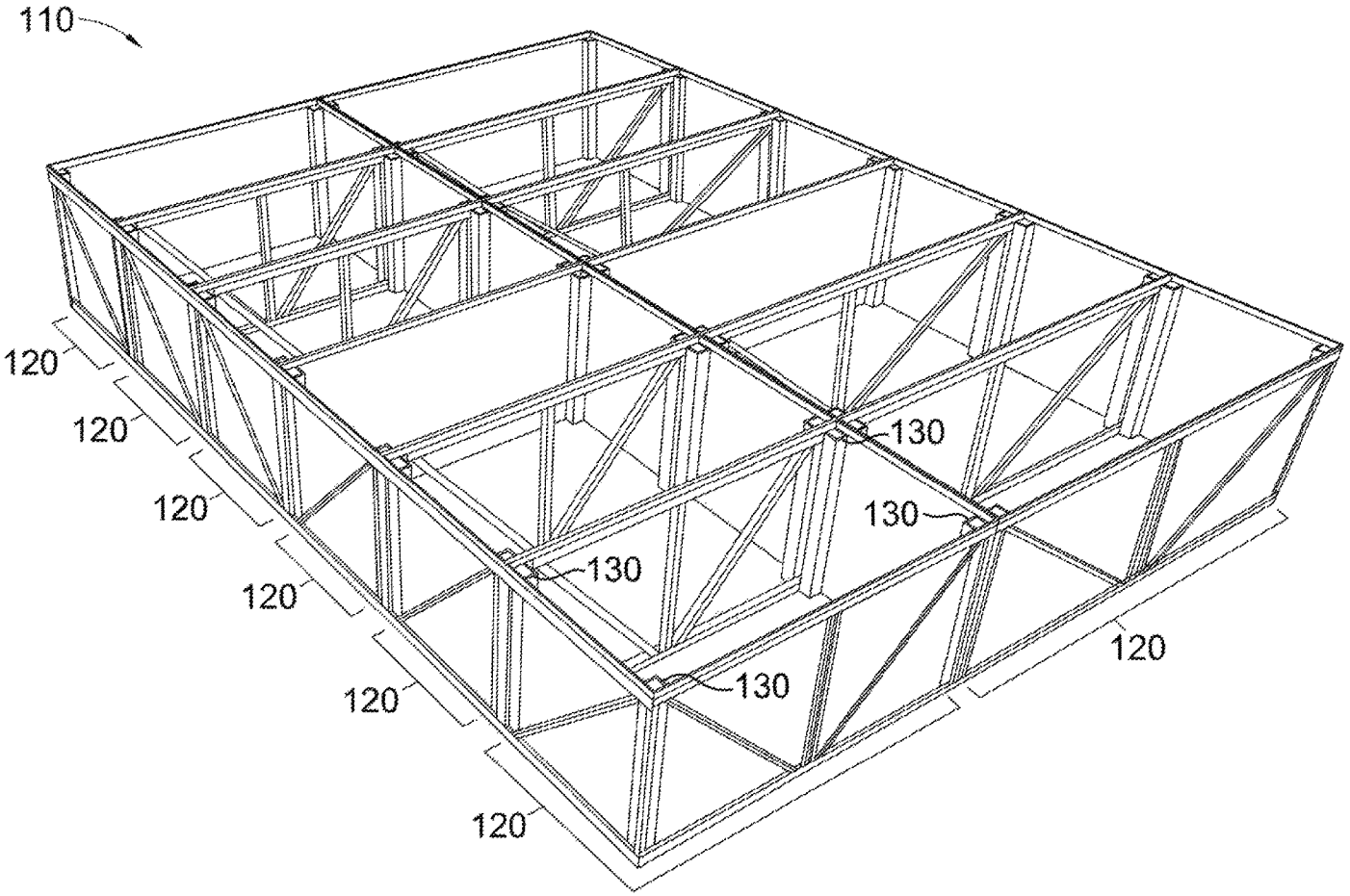
FIG. 2 depicts one embodiment of an underfloor support structure.

FIG. 2 depicts one embodiment of an underfloor support structure 110. An underfloor support structure is part of a building infrastructure—an inner, unseen structural frame of a building—and, in particular, the part of a building infrastructure that is underneath and supports a floor. Preferably, the underfloor support structure 110 has a rectangular prismatic configuration, though other configurations are possible. In one embodiment, the underfloor support structure 110 comprises steel. In one embodiment, the underfloor support structure 110 also comprises sound-proofing materials, such as mass loaded vinyl and foam. In other embodiments, the underfloor support structure 110 comprises other materials, such as aluminum or other metals, wood, engineered wood products, or plastic. The underfloor support structure 110 comprises a plurality of partitions 120. Each partition 120 is a framed-in open space, such that a frame 140 can nest removably inside each partition 120. Preferably, each partition 120 comprises a rectangular prismatic configuration. In one embodiment, each partition 120 is between approximately three to five feet wide, three to five feet high, and seven to nine feet long. Preferably, each partition 120 is approximately four feet wide, eight feet long, and four feet high. This size enables each partition 120 to house a variety of objects, including large ones, such as household appliances and furniture, while still providing enough support for the weight of a floor on top. This size also corresponds to the standard size of many building materials, such as wood products. Each partition 120 also comprises one or more lifting devices 130.

Figure 3:
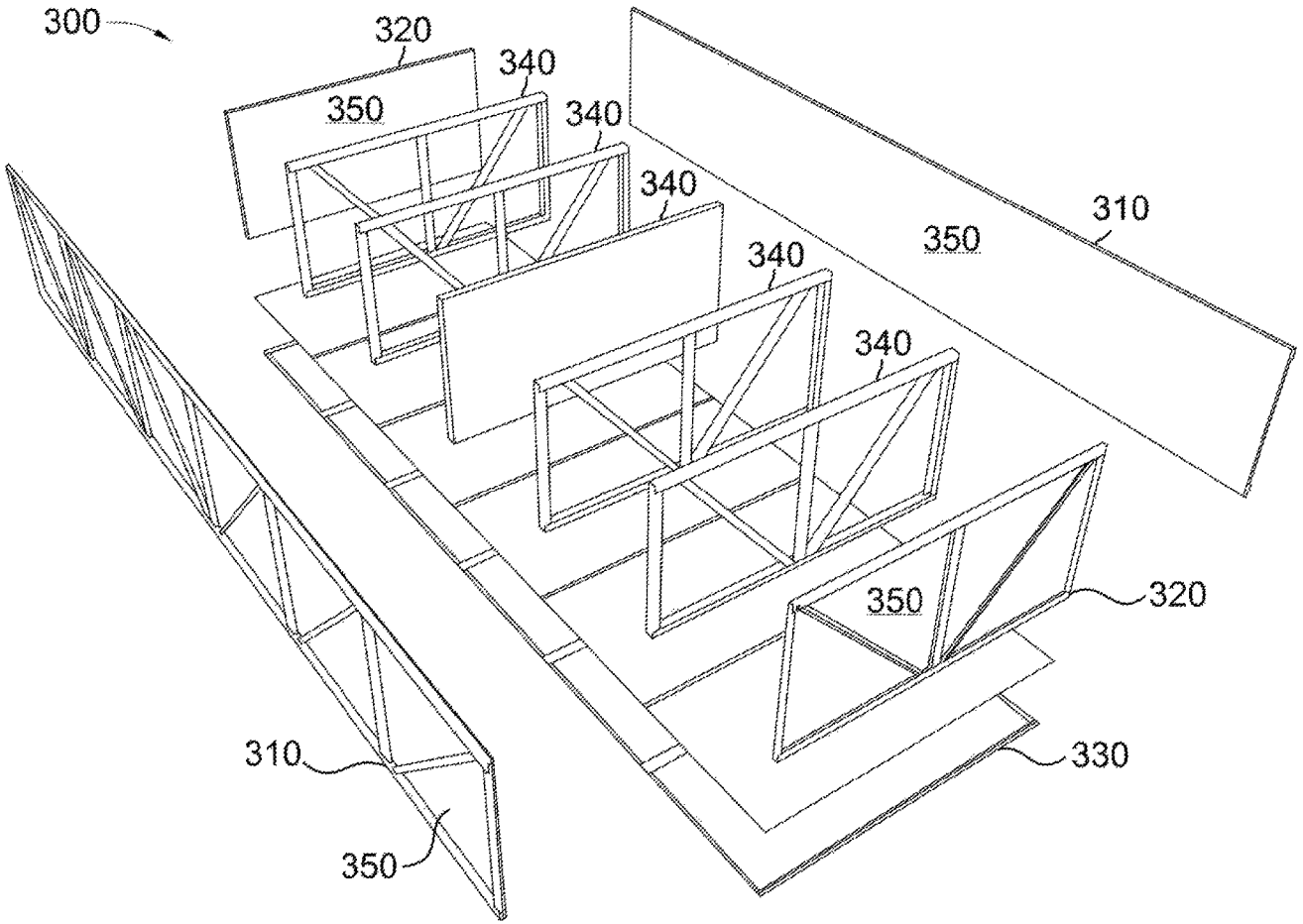
FIG. 3 depicts an exploded view of one embodiment of a modular unit.

In one embodiment, the underfloor support structure 110 comprises one or more modular units 300. FIG. 3 depicts an exploded view of one embodiment of a modular unit 300. Preferably, each modular unit 300 comprises a rectangular prismatic configuration, though some embodiments comprise other configurations. In one embodiment, each modular unit 300 comprises two long trusses 310, two outer bulkhead trusses 320, and a base frame 330 arranged in a rectangular prismatic configuration. In one embodiment, the long trusses 310 comprise hollow structural steel tubes with flat pieces of steel bent into Z-shaped or hat-shaped crossbeams. The bulkhead trusses 320 comprise thin sheets of steel bent into U-shaped channels. The base frame 330 also comprises steel. Other embodiments comprise other materials, such as other metals, wood, engineered wood products, or plastic. Several inner bulkhead trusses 340 divide the modular unit 300 into a plurality of partitions 120. Preferably, one modular unit 300 comprises six partitions 120. Preferably, each partition 120 comprises a rectangular prismatic configuration. In one embodiment, each partition 120 is approximately four feet wide, eight feet long, and four feet high. In one embodiment, the long trusses 310, the outer bulkhead trusses 320, and the base frame 330 are lined with sound-proofing materials 350. The sound-proofing materials 350 may comprise mass loaded vinyl or mass loaded vinyl on top of foam. In one embodiment, the one or more modular units 300 consist of flat packable components. Each long truss 310, each outer bulkhead truss 320, each inner bulkhead truss 340, and the base frame 330 are flat packable. In one embodiment, the long trusses 310, the outer bulkhead trusses 320, the inner bulkhead trusses 340, and the base frame 330 comprise strategically placed holes that do not affect the structural integrity but that allow the long trusses 310, the outer bulkhead trusses 320, the inner bulkhead trusses 340, and the base frame 330 to be constructed remotely by means of spot welding. Each of the pre-constructed, flat packable trusses and frames can then be shipped to the construction site where the one or more modular units can be assembled with bolts and screws.

Figure 4A:
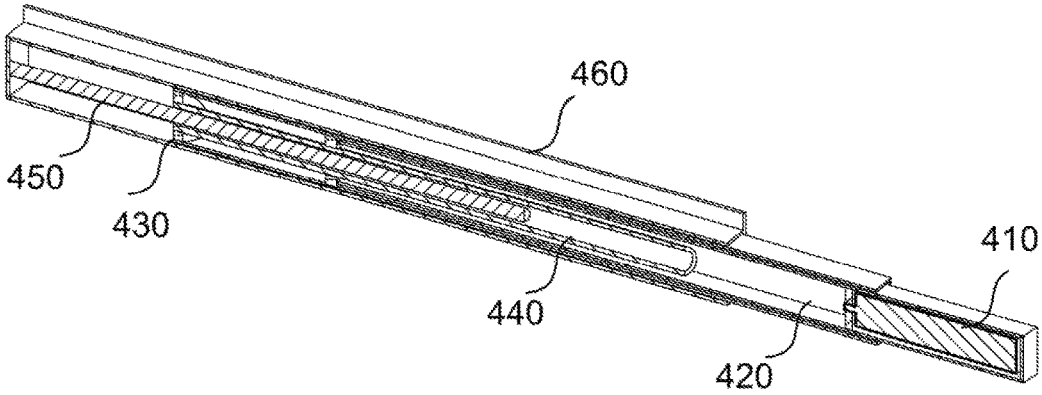
FIG. 4A depicts an interior view of one embodiment of a lifting device.

FIG. 4A depicts one embodiment of a lifting device 130. Each partition 120 of the underfloor support structure 110 comprises one or more lifting devices 130. In one embodiment, the one or more lifting devices 130 comprise automated lifting devices. In some embodiments, the one or more lifting devices 130 are selected from a group comprising telescoping rods, hydraulic and pneumatic telescoping systems, air bags, scissor lifts, pulley systems, linear actuators, and rack and pinion devices. In one embodiment, the one or more lifting devices 130 comprise lifting columns. FIG. 4A depicts a lifting column. A lifting column is a linear actuator with a stable guide. In one embodiment, a lifting column comprises a motor 410. The motor 410 is completely hidden from outside view by a frame 460. The motor 410 is attached to and rotates a hollow tube 420, preferably made of metal and in a hexagonal configuration. The hollow tube 420 comprises a nut 430. The nut 430 encircles a large threaded screw 440 that is disposed within the hollow tube 420. The large threaded screw 440 is also hollow, and a small threaded screw 450 is disposed within the large threaded screw 440. The rotation of the hollow tube 420 and nut 430 by means of the motor 410 causes the hollow tube 420 to rise, crawling up the threads of the large threaded screw 440. The large threaded screw 440 interfaces with the small threaded screw 450 such that the large threaded screw 440 rises too, crawling up the threads of the small threaded screw 450. The rising hollow tube 420 and large threaded screw 440 are enclosed by the housing 460, which rises with them in tiers, each tier rising higher than the last. In one embodiment, the lifting column has three tiers.

Figure 4B:
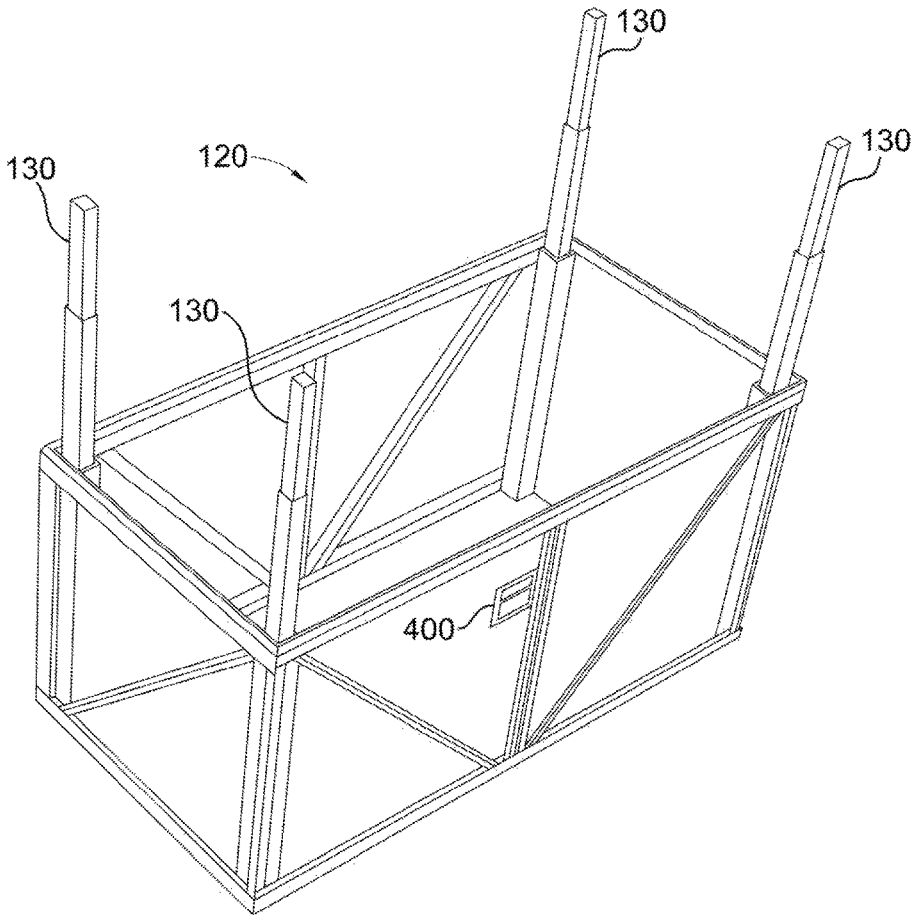
FIG. 4B depicts one embodiment of a single partition of the underfloor support structure comprising one or more lifting devices.

FIG. 4B depicts one embodiment of a single partition 120 of the underfloor support structure 110 comprising one or more lifting devices 130. In one embodiment, the one or more lifting devices 130 comprise automated lifting devices. In one embodiment, the one or more lifting devices 130 comprise lifting columns. In other embodiments, the one or more lifting devices 130 are selected from a group comprising telescoping rods, hydraulic and pneumatic telescoping systems, air bags, scissor lifts, pulley systems, linear actuators, and rack and pinion devices. In one embodiment, each partition 120 comprises four lifting devices 130 and each of the four lifting devices 130 is secured in a corner of the partition 120. In one embodiment, the one or more lifting devices 130 in each partition 120 are attached to the floor piece 150 of a frame 140. When the one or more lifting devices 130 are actuated, the one or more lifting devices 130 lift the floor piece 150 of the frame 140, and the frame 140 hangs from the floor piece 150, such that the frame 140 lifts from within the partition 120 when the floor piece 150 is lifted by the one or more lifting devices 130. In one embodiment, the one or more lifting devices 130 in each partition 120 are synchronized. In one embodiment, each partition 120 has a microcontroller 400 that is connected to each of the one or more lifting devices 130 in the partition 120. In one embodiment, the microcontroller 400 of each partition 120 is in communication with a central controller. The central controller may receive user inputs that allow a user to control when the one or more lifting devices 130 of each partition 120 are actuated. In different embodiments, a user interface for entering the user inputs may comprise voice control, buttons, or a touch-sensitive display on a mobile device.

Figure 5:
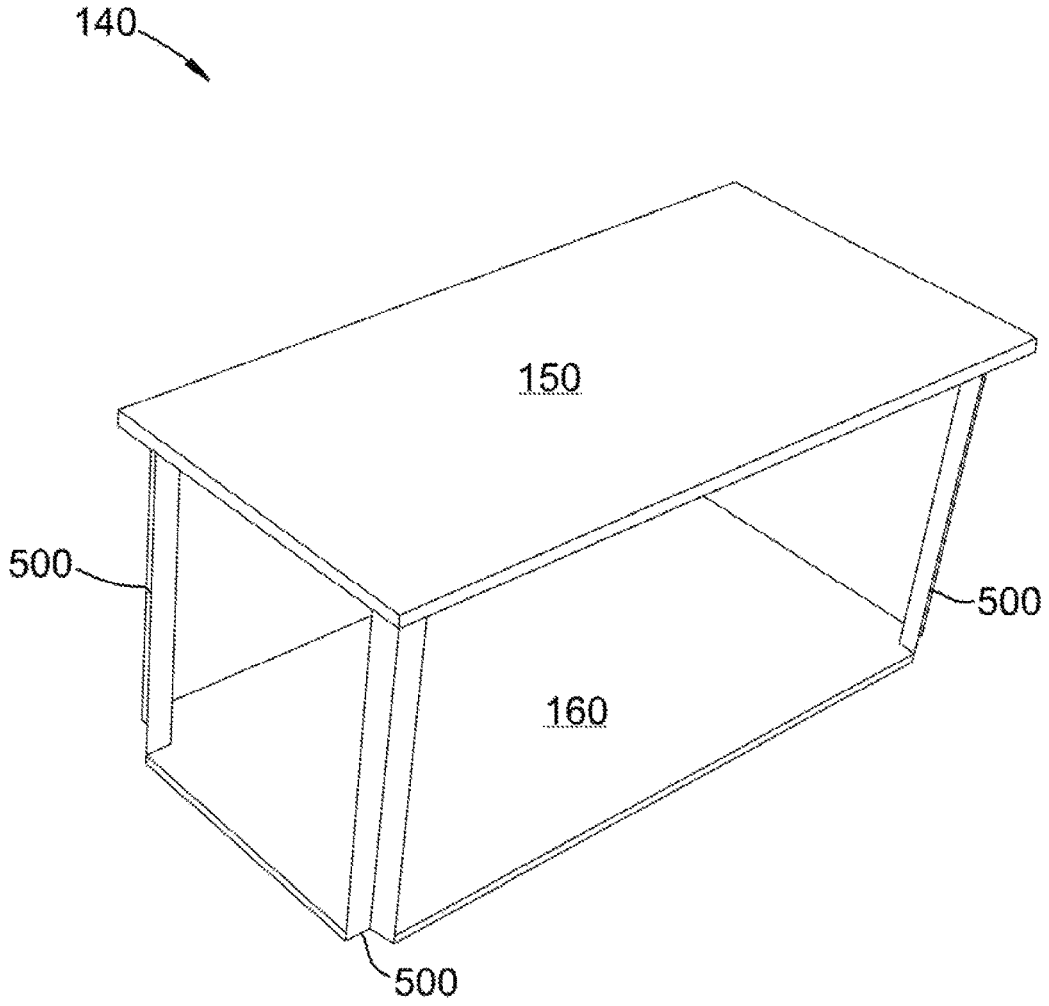
FIG. 5 depicts one embodiment of a frame.

FIG. 5 depicts one embodiment of a frame 140. The invention comprises a plurality of frames 140 that nest removably inside the plurality of partitions 120 of the underfloor support structure 110. In one embodiment, each frame 140 comprises a rectangular prismatic configuration. Preferably, each frame 140 has an identical configuration to that of each partition 120 in which it nests, and each frame 140 fits snuggly within each partition 120. In one embodiment, space between each frame 140 and each partition 120 is less than approximately one inch along every side. In one embodiment, each frame 140 measures slightly less than approximately four feet high, four feet wide, and eight feet long. In one embodiment, each frame 140 comprises thin sheets of steel bent into beams and crossbeams, welded and bolted together. Each frame 140 comprises a floor piece 150 mounted atop the frame 140 and a sub-floor piece 160 mounted to a bottom of the frame 140. In one embodiment, a top side and a bottom side of each frame 140 are dimensioned and designed to hold the floor piece 150 and the sub-floor piece 160 respectively. Between each floor piece 150 and sub-floor piece 160 is usable space. In one embodiment, the usable space is used for storage. In one embodiment, the usable space is used for storing household appliances. In another embodiment, the usable space stores household furniture selected from a group comprising tables, chairs, couches, lamps, desks, dressers, shelves, benches, beds, and ottomans. The one or more lifting devices 130 lift the plurality of frames 140 and any contents of the usable space from within the plurality of partitions 120 of the underfloor support structure 110. In one embodiment, each frame 140 hangs from its floor piece 150, and the one or more lifting devices 130 in each partition 120 are attached to only and lift only the floor piece 150, and the frame 140 lifts when the floor piece 150 is lifted. In one embodiment, corners 500 of each frame 140 point inward, leaving an indentation where one or more lifting devices 130 can be placed and attached to the floor piece 150.

Figure 6:
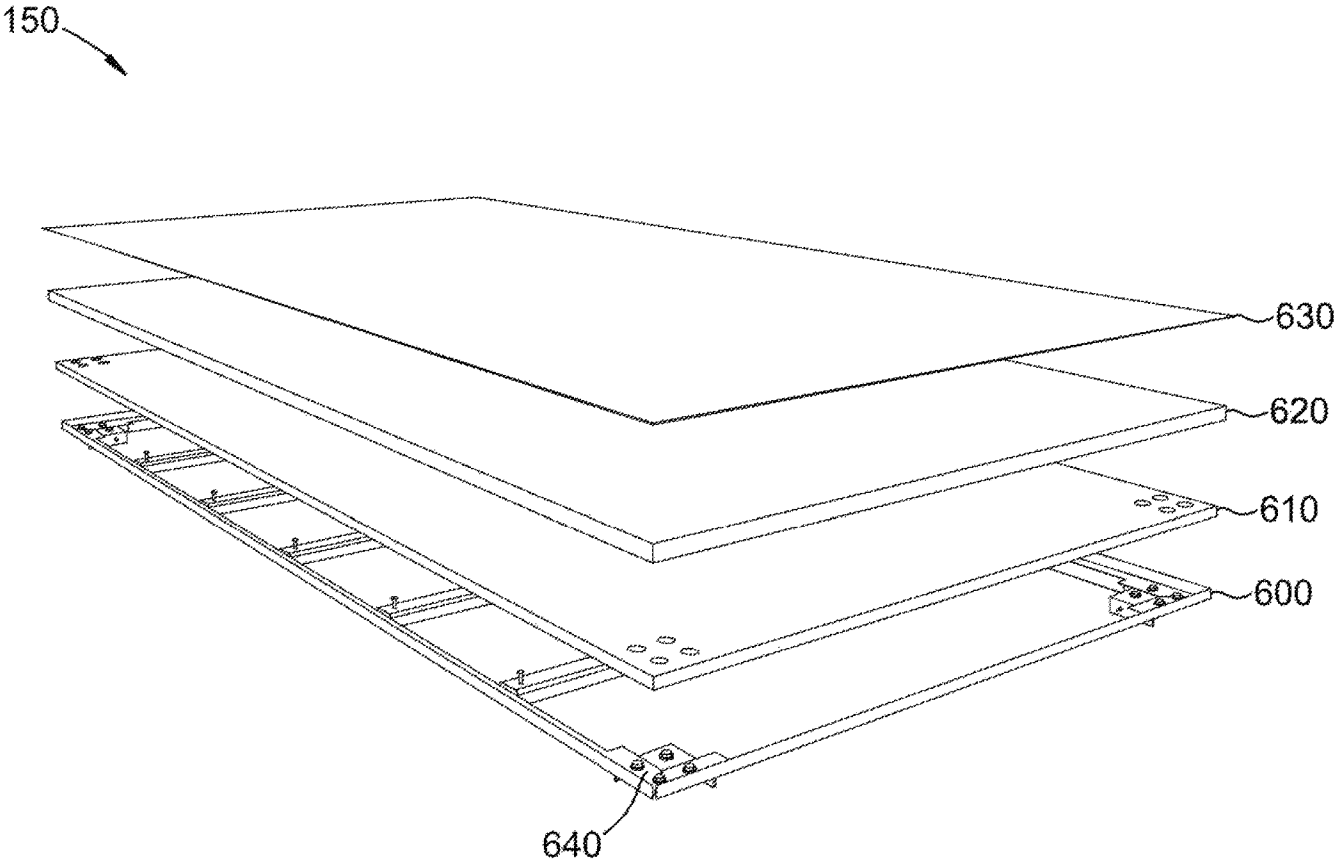
FIG. 6 depicts an exploded view of one embodiment of a floor piece of the frame.

FIG. 6 depicts an exploded view of one embodiment of a floor piece 150 of the frame 140. Each frame 140 comprises a floor piece 150 mounted atop the frame 140. In one embodiment, the floor piece 150 comprises a skeleton framework 600 comprising steel beams shaped and dimensioned to hold a floor. In one embodiment, on top of the skeleton framework 600 is a rigid panel 610 of the floor piece 150 that can hold substantial weight, preferably comprising oriented strand board (OSB), but alternatively comprising wood or other engineered wood products. In one embodiment, the floor piece 150 of each frame 140 also comprises anti-fatigue flooring 620, such as SmartCells, on top of the rigid panel 610. In one embodiment, the anti-fatigue flooring 620 is also topped by a finishing layer 630. The finishing layer 630 may comprise wood veneer, vinyl, tiling, laminate, carpet, or other types of flooring commonly known in the art. In one embodiment, the floor piece 150 also comprises connectors 640 where the one or more lifting devices 130 can attach to the floor piece 150. In one embodiment, the sub-floor piece 160 is structured similarly to the floor piece 150.

Figure 7A:
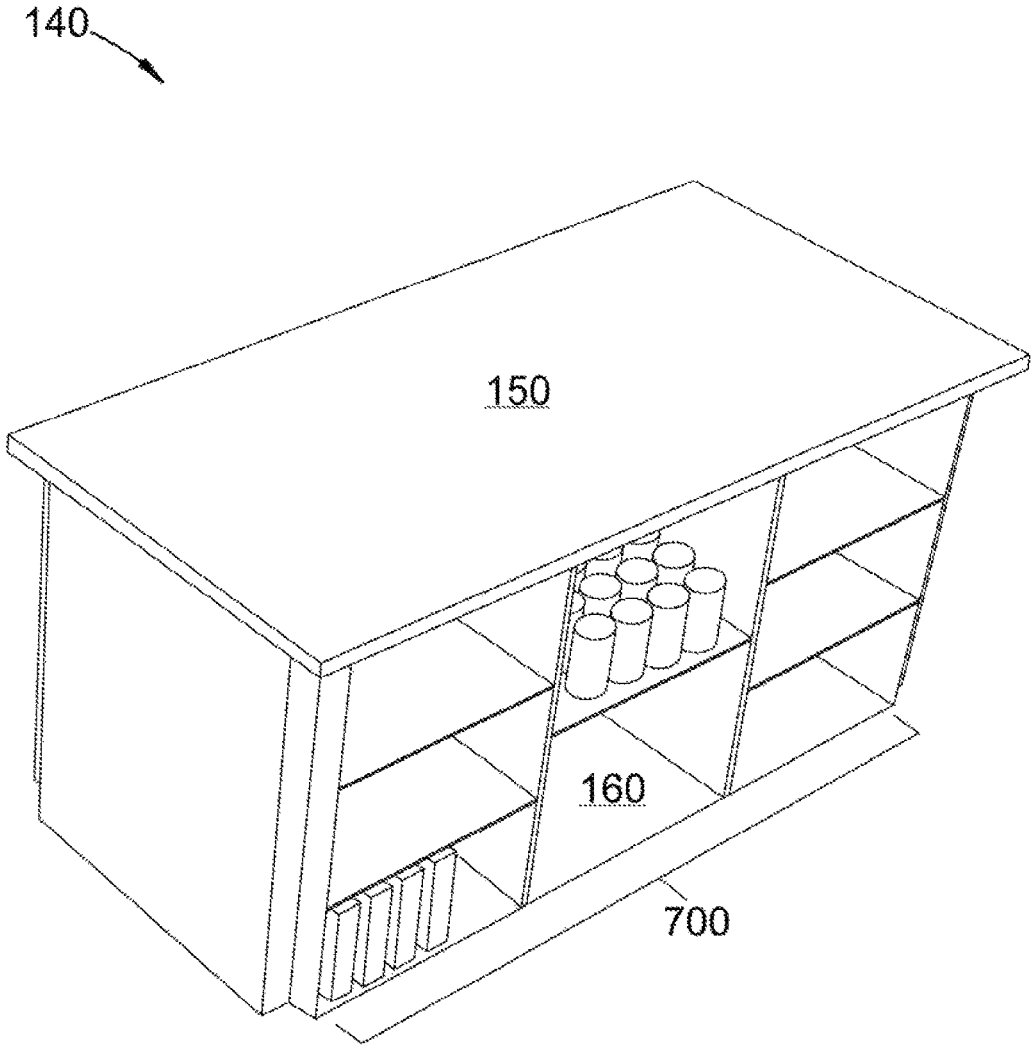
FIG. 7A depicts one embodiment of a frame comprising shelving.
Figure 7B:
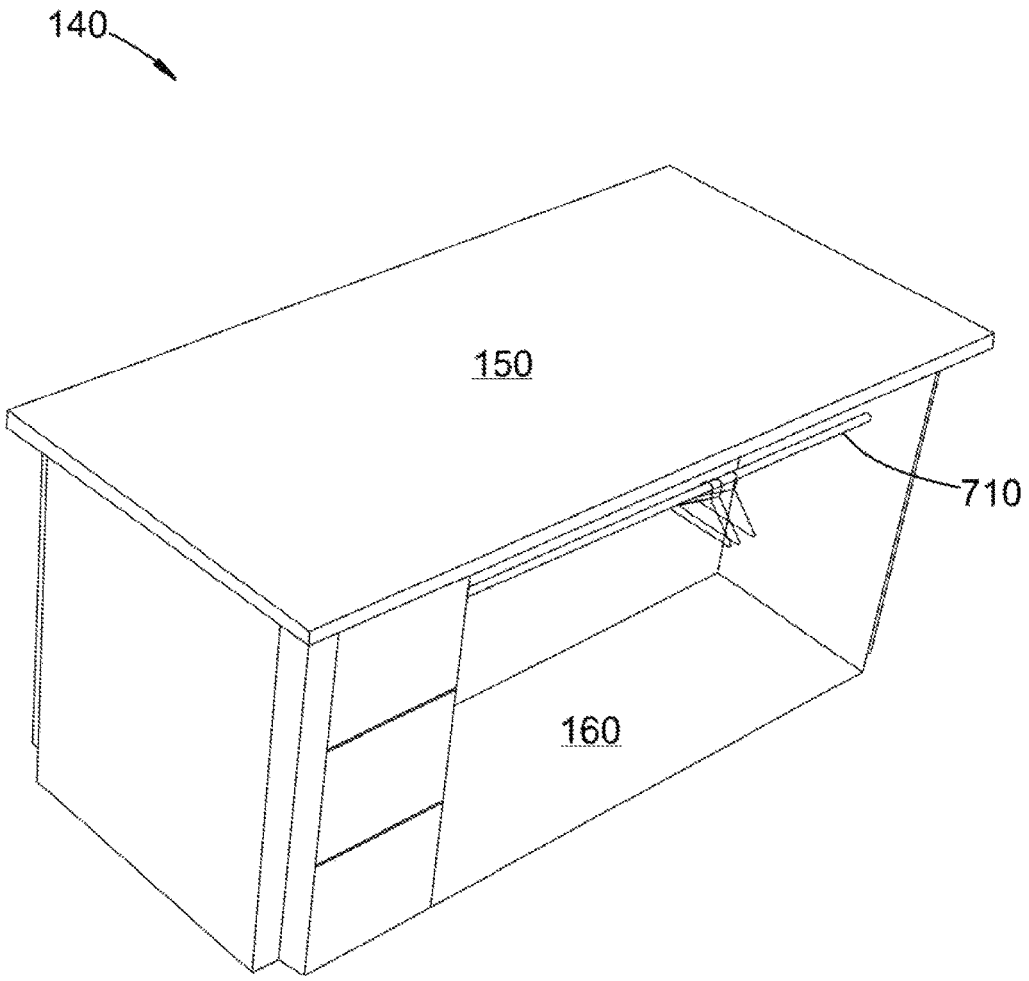
FIG. 7B depicts one embodiment of a frame comprising hanging rods.
Figure 7C:
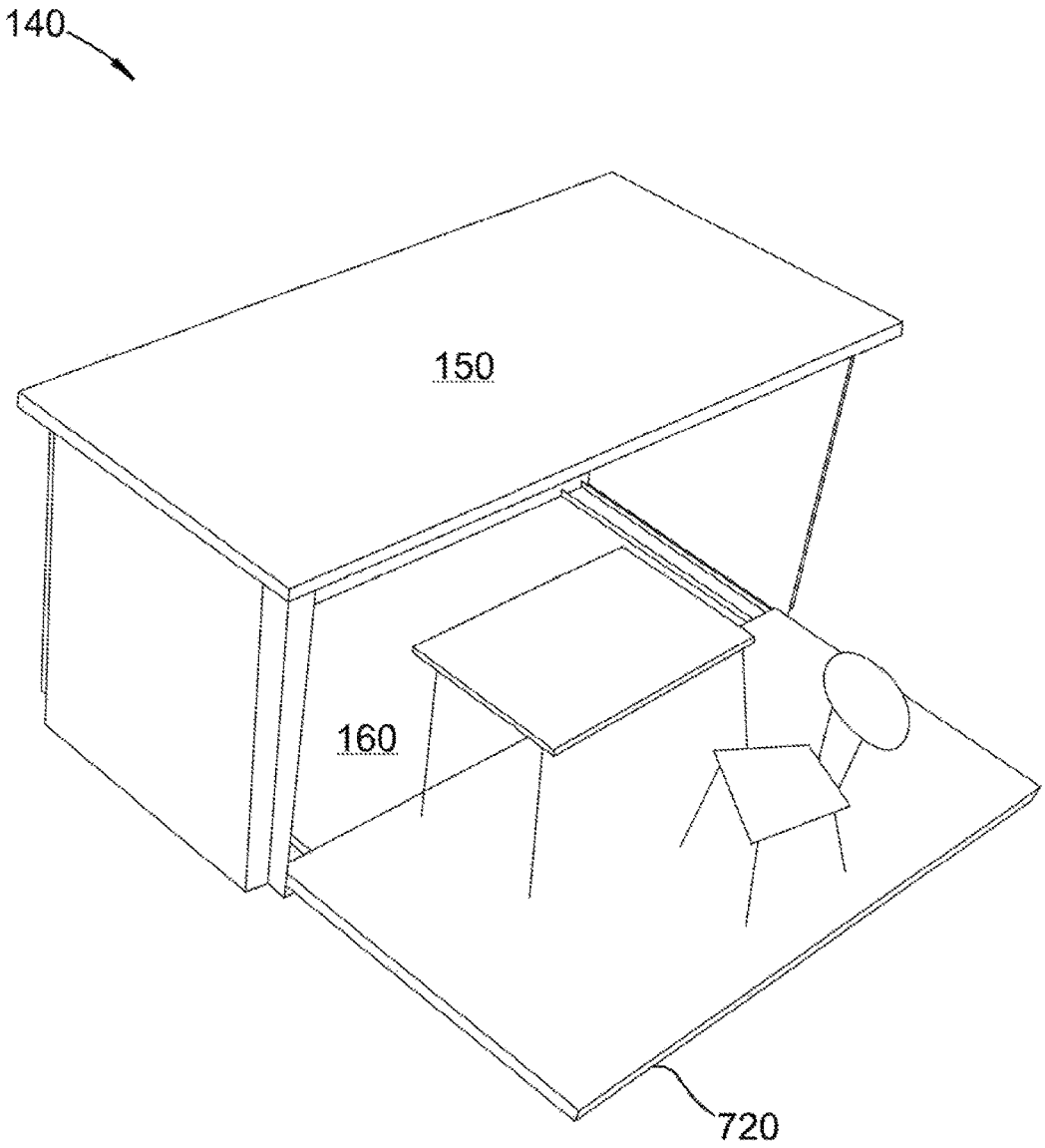
FIG. 7C depicts one embodiment of a frame comprising a slide-out floor.

FIG. 7A-7C depict embodiments of frames 140 comprising interior organizational systems. Each frame 140 comprises a floor piece 150 and a sub-floor piece 160, and between each floor piece 150 and sub-floor piece 160 is usable space. In one embodiment, the usable space stores household appliances. In another embodiment, the usable space stores household furniture selected from a group comprising tables, chairs, couches, lamps, desks, dressers, shelves, benches, beds, and ottomans. In other embodiments, the usable space stores any of a variety of other things capable of fitting within the frame 140. In some embodiments, the usable space of the plurality of frames 140 comprises interior organizational systems. In one embodiment, the plurality of frames 140 comprise shelving 700. FIG. 7A depicts this embodiment. In one embodiment, the plurality of frames 140 comprise hanging rods 710. FIG. 7B depicts this embodiment. In one embodiment, the plurality of frames 140 comprise slide-out floors 720. FIG. 7C depicts this embodiment.

Figure 8:
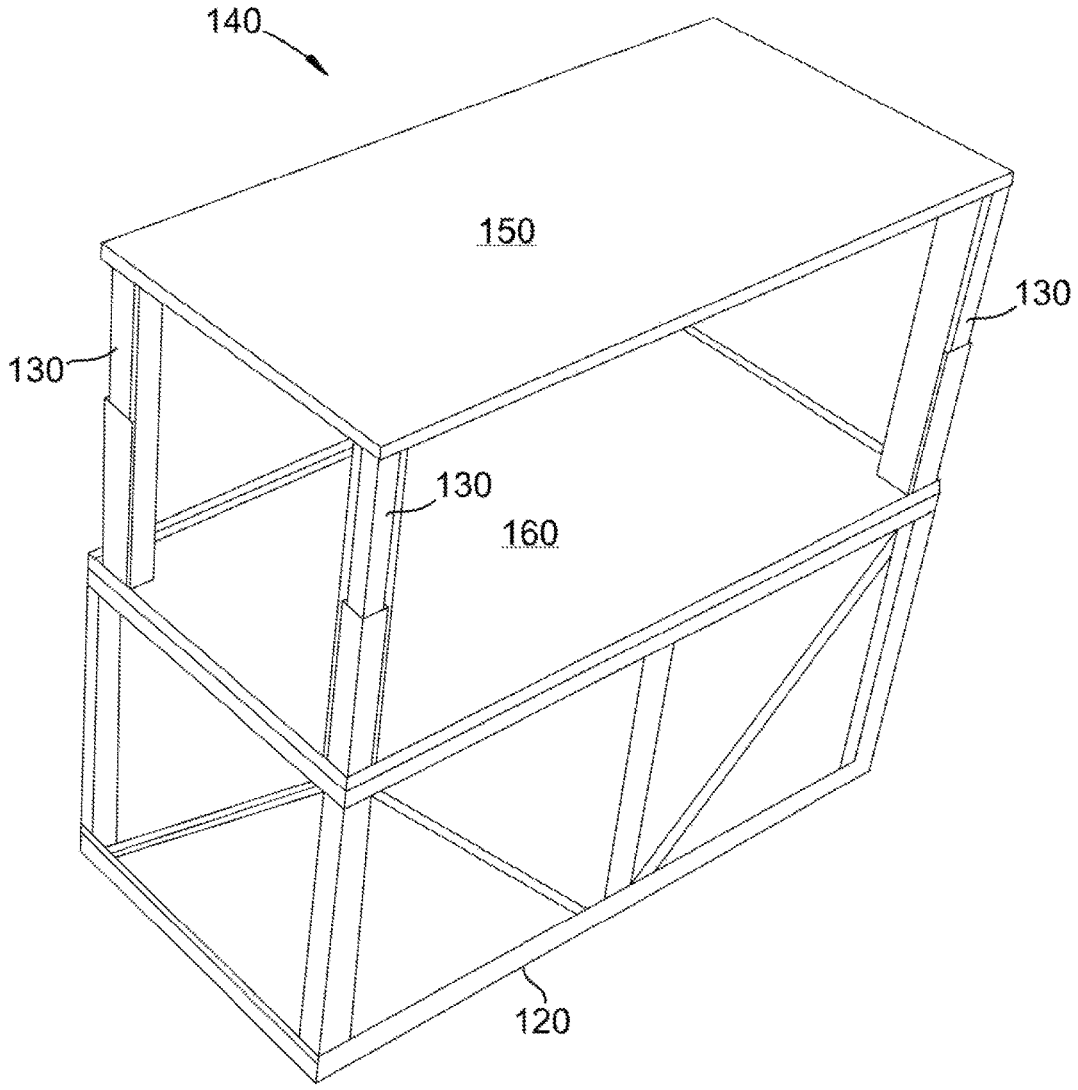
FIG. 8 depicts one embodiment of one or more lifting devices lifting a frame from within a partition of the underfloor support structure, exposing usable space between a floor piece and a sub-floor piece.

FIG. 8 depicts one embodiment of one or more lifting devices 130 lifting a frame 140 from within a partition 120 of the underfloor support structure 110, exposing usable space between a floor piece 150 and a sub-floor piece 160. In one embodiment, each partition 120 of the underfloor support structure 110 comprises four lifting devices 130. In one embodiment, the one or more lifting devices 130 in each partition 120 are synchronized, or actuated simultaneously. In one embodiment, the one or more lifting devices 130 are attached to and lift only the floor piece 150, and the frame 140 hangs from the floor piece 150, such that the frame 140 lifts when the floor piece 150 is lifted. Any contents of the usable space between the floor piece 150 and the sub-floor piece 160 are also lifted with the frame 140. The one or more lifting devices 130 may be attached to the floor piece 150 by means of bolts or screws. In other embodiments, the one or more lifting devices 130 are positioned underneath the frame 140 and lift from the bottom. In other embodiments, the one or more lifting devices lift from the sides or corners. In one embodiment, the usable space that is exposed between the floor piece 150 and the sub-floor piece 160 stores household appliances. In another embodiment, the usable space stores household furniture selected from a group comprising tables, chairs, couches, lamps, desks, dressers, shelves, benches, beds, and ottomans. In other embodiments, the usable space stores any of a variety of other things capable of fitting and being lifted within the frame 140.

Figure 9:
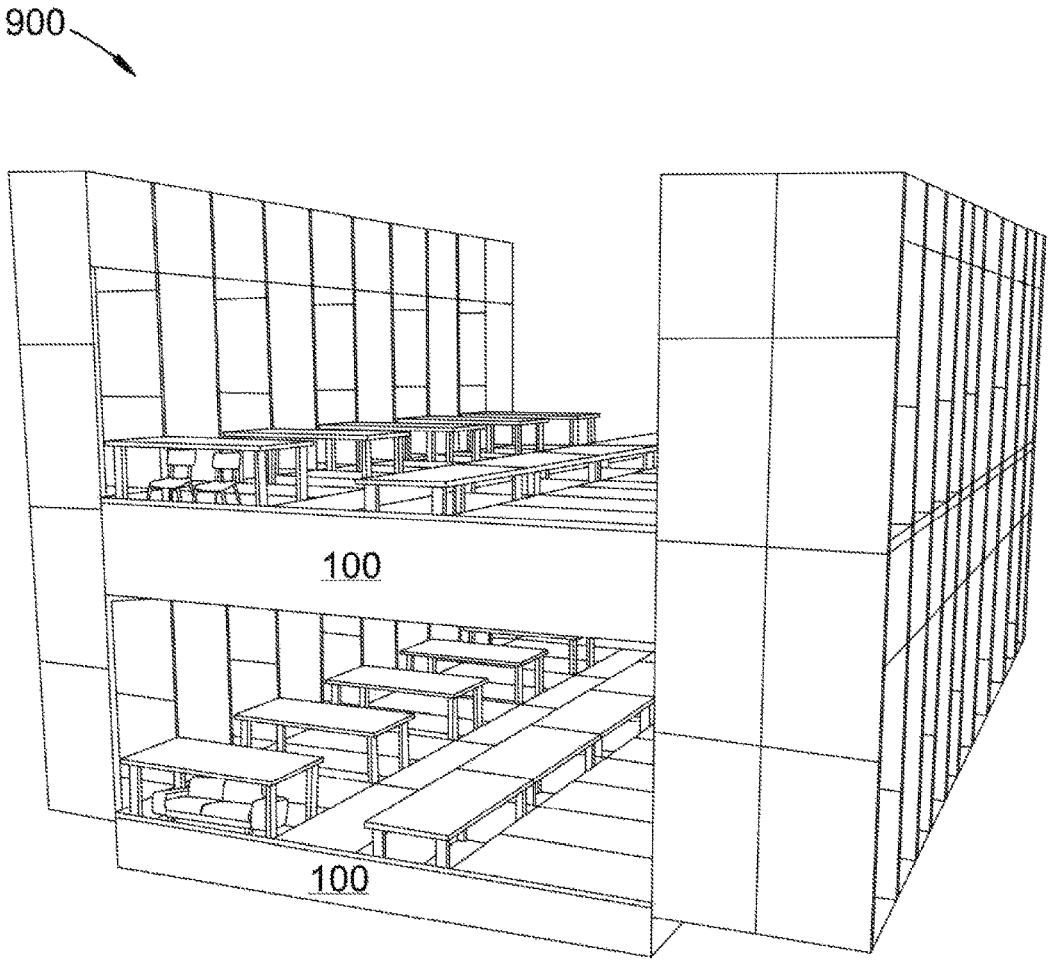
FIG. 9 depicts a building comprising a lifting floor system.

FIG. 9 depicts a building 900 comprising the lifting floor system 100 of the instant invention. Each level of the building utilizes the lifting floor system 100. In one embodiment, the underfloor support structure 110 comprises one or more modular units 300, comprising a plurality of partitions 120. Each partition 120 houses a frame 140 that is lifted by one or more lifting devices 130 within the partition 120. When the one or more lifting devices 130 lift the plurality of frames 140 from within the plurality of partitions 120, usable space is exposed between a floor piece 150 and a sub-floor piece 160 of each frame 140. A variety of objects may be stored within the usable space, including household appliances and furniture, in some embodiments.

The invention claimed is:

1. An underfloor storage system for use in a reconfigurable room comprising:

an underfloor support structure comprising at least four modular units, with the modular units arranged and attached to one another in an end to end and side by side array, each modular unit comprising a plurality of trusses forming a rectangular prismatic configuration;

two or more floor platforms, each resting upon a modular unit and forming part of a floor for the reconfigurable room;

two or more storage boxes, each of which nests inside a modular unit, and is adapted to be moved between a lowered position within the modular unit and a raised position, wherein each storage box comprises:

a storage box top platform, adapted to be level with the floor platforms and form part of the floor when the storage box is in the lowered position;

a sub-floor platform, for supporting items stored in the storage box, and adapted to be level with the floor platforms when the storage box is in the raised position; and vertical supports, connecting the storage box top platform and the sub-floor platform;

lifting devices associated with each one of the storage boxes, and configured to move the associated storage box between the lowered and raised positions; and wherein each of the modular units has either a floor platform atop it or a storage box within it, whereby a level, contiguous floor is provided for the reconfigurable room when all of the storage boxes are in the lowered position.

2. The invention of claim 1, wherein each lifting device comprises an automated lifting device.

3. The invention of claim 2, wherein each lifting device comprises a lifting column.

4. The invention of claim 2, wherein the lifting devices is are selected from a group comprising of telescoping rods, hydraulic and pneumatic telescoping systems, air bags, scissor lifts, pulley systems, linear actuators, and rack and pinion devices.

5. The invention of claim 1, wherein the modular units comprise sound-proofing materials.

6. The invention of claim 1, wherein each lifting device each comprises four motors.

7. The invention of claim 1, wherein each modular unit is approximately four feet wide.

8. The invention of claim 1, wherein each modular unit is approximately eight feet long.

9. The invention system of claim 1, wherein each modular unit is approximately four feet high.

10. The invention of claim 1, wherein at least one of the storage boxes comprises shelving.

11. The invention of claim 1, wherein at least one of the storage boxes comprises a hanging rod.

12. The invention of claim 1, wherein the storage box top platform comprises anti-fatigue flooring.

13. The invention of claim 1, wherein the sub-floor platform is configured to hold household appliances.

14. The invention of claim 1, wherein at least one of the storage boxes stores household furniture selected from a group comprising tables, chairs, couches, lamps, desks, dressers, shelves, benches, beds, and ottomans.

15. The invention of claim 1, wherein the plurality of lifting devices are disposed within each corner of each partition.

* * * * *